United States Patent [19]

Tanuma et al.

[11] 4,147,031

[45] Apr. 3, 1979

[54] INTERNAL COMBUSTION ENGINE WITH EXHAUST GAS RECIRCULATION SYSTEM

[75] Inventors: Takeshi Tanuma; Masanori Harada, both of Yokohama, Japan

[73] Assignee: Nissan Motor Company, Limited, Yokohama, Japan

[21] Appl. No.: 793,500

[22] Filed: May 4, 1977

[30] Foreign Application Priority Data

May 11, 1976 [JP] Japan ..... 51/58448

[51] Int. Cl.[2] ..... F02M 25/06; F01N 3/15

[52] U.S. Cl. ..... 60/278; 60/299

[58] Field of Search ..... 60/278, 282, 299, 320, 60/321

[56] References Cited

U.S. PATENT DOCUMENTS

| | | | |
|---|---|---|---|
| 3,302,394 | 2/1967 | Pahnke | 60/302 |
| 3,457,723 | 7/1969 | Kerns | 60/299 |
| 3,798,904 | 3/1974 | Gleason | 60/320 |
| 3,850,453 | 11/1974 | Bentley | 60/282 |
| 3,948,044 | 4/1976 | Wakita | 60/278 |
| 4,041,700 | 8/1977 | Okamoto | 60/278 |
| 4,065,919 | 1/1978 | Eknayan | 60/278 |

FOREIGN PATENT DOCUMENTS

| | | | |
|---|---|---|---|
| 369594 | 3/1939 | Italy | 60/321 |

*Primary Examiner*—Douglas Hart

[57] ABSTRACT

A part of the exhaust gases from an engine proper is fed into an intake manifold via an insulated space which is formed between an inner shell defining therein an exhaust gas passage through which the exhaust gases from the engine proper pass before discharging into the open air, and an outer shell spacedly but substantially covering the inner shell.

9 Claims, 5 Drawing Figures

INTERNAL COMBUSTION ENGINE WITH EXHAUST GAS RECIRCULATION SYSTEM

FIELD OF THE INVENTION

The present invention relates in general to an internal combustion engine system for a motor vehicle, and more particularly to an internal combustion engine system equipped with an exhaust gas recirculation system (EGR system) which diverts a portion of the exhaust into the intake of the engine system.

BACKGROUND OF THE INVENTION

Usually, a so called EGR system consists of a tube or pipe connecting the interior of the intake conduit with that of the exhaust conduit of the engine, and a gas flow controller operatively disposed in the tube to control the flow rate of the gases passing therethrough in response to engine conditions.

Recently, due to the sake of reducing $NO_x$ emission, an internal combustion engine system for a motor vehicle is equipped with a so-called high EGR system by which a large amount of exhaust gases is fed to the intake of the engine system. In such an engine system, it is very necessary to arrange the EGR system such that only exhaust gases cleaned of some particles such as carbon particles are fed into the intake of the engine in order to prevent the tube of the EGR system from being plugged with such particles. In fact, the deposition of such particles in the tube cause a remarkable increase of flow resistance of the EGR system.

Thus, in a conventional high EGR system, the inlet opening of the system is located at a portion downstream of some exhaust gas purifying devices such as a thermal reactor and a catalytic converter because the exhaust gases having passed through such devices contain a minimum amount of carbon particles.

By using such a conventional EGR system, however, it is inevitably required, for accommodating the above-mentioned large volume of exhaust gas feed into the intake, that the tube or pipe of the EGR system is considerably long and considerably large in cross section. Thus, the whole structure of the engine system becomes bulky thus limiting the space of the engine room of the motor vehicle. Furthermore, the assemblage of such tube to the engine proper will be difficult due to the bulky construction of it.

SUMMARY OF THE INVENTION

Therefore, the present invention contemplates to eliminate the above-mentioned drawbacks encountered in the conventional engine system.

It is an object of the present invention to provide an internal combustion engine system which is equipped with an improved compactly constructed exhaust gas recirculation system (EGR system).

It is another object of the present invention to provide an improved EGR system which uses enclosed spaces defined around an exhaust conduit system of the engine as an EGR conduit.

BRIEF DESCRIPTION OF THE DRAWINGS

Other objects and advantages of the present invention will become apparent from the following description when taken in conjunction with the accompanying drawings, in which.

DESCRIPTION OF THE PREFERRED EMBODIMENT

Figure 1:
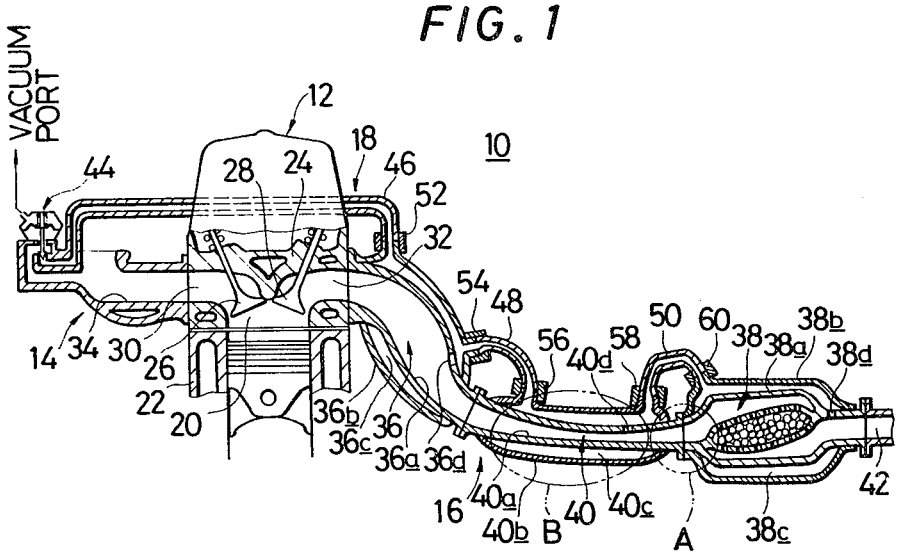
FIG. 1 is a longitudinal sectional view of an internal combustion engine system according to the present invention incorporating an improved EGR system.

Referring to FIG. 1 of the drawings, there is illustrated an engine system of the invention, as being generally designated by a reference numeral 10. The engine system generally comprises an engine proper section 12, an intake section 14, an exhaust section 16 and an exhaust gas recirculating section 18.

The engine proper section 12 is illustrated to have combustion chambers 20 (only one chamber is illustrated in this drawing) each consisting of an upper portion of a cylinder bore (no numeral) formed in a cylinder block 22 and a recess (no numeral) formed in a cylinder head 24. Each combustion 20 is communicable through intake and exhaust valve 26 and 28 with intake and exhaust ports 30 and 32 in a conventional manner. Although not shown in this drawing, at least one ignition plug is mounted in each combustion chamber 20 for the ignition of the combustible mixture fed thereinto.

The intake section 14 generally comprises an air-fuel mixture supply means such as a carburetor (not shown), and an intake manifold 34 having passageways therein each communicating with respective one of the intake ports 30.

The exhaust section 16 comprises a thermal reactor 36 fluidly connected to the exhaust ports 32 for thermally treating the exhaust gases from the combustion chambers 20, and a catalytic converter 38 fluidly connected through a connecting tube 40 to the thermal reactor 36 for catalytically treating the gases having passed through the thermal reactor 36 before the gases are emitted to the open air through a tail tube or pipe 42. As is well shown in this drawing, each of these elements 36, 40 and 38 is constructed to have a heat insulating space therein. More specifically, the thermal reactor 36 is constructed to have an insulating space **36*c* between an inner shell 36*a* defining therein a reaction chamber (no numeral), and an outer shell 36*b* spacedly covering the inner shell 36*a*. Preferably, the inner and outer shells 36*a* and 36*b* are formed integral with each other to form a monocast construction. In the same way, the connecting tube 40 and the catalytic converter 38 are formed with insulating spaces 40*c* and 38*c*, respectively, the space 40*c* being defined by inner and outer shells 40*a* and 40*b*, and the space 38*c* being defined by inner and outer shells 38*a* and 38*b*, as shown in the drawing. These insulating spaces 36*c*, 40*c* are used for preventing the exhaust gases passed through the exhaust conduit section 16 from excessive heat loss to maintain the exhaust gases at an elevated temperature. As will be well understood from the following description, such insulating spaces 36*c*, 38*c*, and 40*c* can act as a part of the exhaust gas recirculating section 18**.

The exhaust gas recirculating section 18 comprises the spaces 36c, 38c and 40c mentioned above, three connecting pipes 46, 48 and 50, and a gas flow controller 44 mounted on a portion of the pipe 46. The pipes 46, 48 and 50 provide respective fluid communications between the interior of the intake manifold 34 and the space 36c via the gas flow controller 44, between the space 36c and the space 40c, and between the space 40c and the space 38c. indicated by numerals 52, 54, 56, 58 and 60 are flare nuts which fasten the pipes 46, 48 and 50 to the corresponding opening portions (no numerals) formed in the outer shells 36b, 40b and 38b. The inner shells 36a, 40 a and 38a of the thermal reactor 36, the connecting tube 40 and the catalytic converter 38 are respectively formed with openings 36d, 40d and 38d each providing a fluid connection between the interior of the exhaust conduit section 16 and the corresponding one of the insulating spaces 36c, 40c and 38c, as shown. The gas flow controller 44 functions in a conventional manner to control the amount of exhaust gases fed into the interior of the intake section 14 in response to the vacuum condition of the intake section in the vicinity of the throttle valve (not shown).

With this construction of the exhaust gas recirculating section 18, it will be appreciated that, during the operation of the engine system 10, a part of exhaust gases emitted from the combustion chambers 20 is fed or recirculated into the interior of the intake manifold 34 through the openings 36d, 40d and 38d, the insulating spaces 36c, 40c and 38c, and the connecting pipes 46, 48 and 50.

From the above, it will be understood that the heat loss in the recirculated exhaust gases critically depends on the ratio of the total length of the connecting pipes to that of the entire conduit portions of the EGR section 18. Thus, by changing the arrangements of the connecting pipes 46, 48 and 50 to the thermal reactor 36, the connecting tube 40 and the catalytic converter 38, the temperature of the recirculated exhaust gases just fed into the intake manifold 34 is varied. More specifically, when a relatively low temperature of the recirculated exhaust gases is required by reasons that a member having poor heat resistance is disposed in the conduit portions of the EGR section 18 and a sharp reduction of $NO_x$ emission is required, the connecting pipe 46 may be directly connected with the connecting pipe 48 while allowing the openings formed in the outer shell 36b of the thermal reactor 36 to be blocked by some suitable plugs (not shown). Of course, the connecting pipe 46 may be connected with the pipe 50 in a case that a still lower temperature is required in the recirculated exhaust gases. On the contrary, when a relatively high temperature of the recirculated exhaust gases is required for the purpose of burning the carbon particles suspended in the gases in the conduit portions of the EGR section 18, and of increasing remarkably the running property of the engine proper, the arrangement of the connecting pipes 46, 48 and 50 as illustrated in this drawing (FIG. 1) is desirable. (It is known that the running property of the internal combustion engine is improved when the air-fuel mixture fed to the combustion chambers thereof is moderately warmed by feeding a proper amount of exhaust gases into the intake manifold.)

The following Table (I) shows some examples of the arrangement between the connecting pipes 46, 48 and 50 and the insulating spaces 36c, 40c and 38c.

Table I

| Example | Arrangements |
|---|---|
| I | 36c — 46 — 44 |
| II | 40c — (48, 46)* — 44 |
| III | 38c — 50 — 40c — (48, 46)* — 44 |

Note
(48, 46)* means that the pipes 48 and 46 are directly connected with each other.

Figure 2:
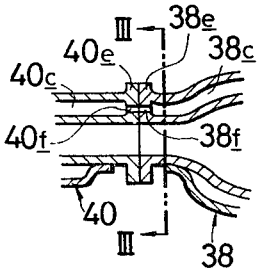
FIG. 2 is a sectional view showing a modified construction of a part indicated by circle A in FIG. 1.
Figure 3:
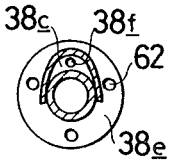
FIG. 3 is a sectional view taken along the line III—III of FIG. 2.

In FIGS. 2 and 3, there is shown an example fluidly connecting two adjacent insulating spaces 40c and 38c of the connecting tube 40 and the catalytic converter 38 without using any pipe. As seen in these drawings, the insulating spaces 40c and 38c are formed to partially extend toward their corresponding flange portions 40e and 38e which contact tightly each other. The flange portions 40e and 38e are respectively formed with through holes 40f and 38f which are in alignment with each other to open to each other. Indicated by numerals 62 in FIG. 3 are holes through which fastening bolts (not shown) are passed to firmly connect the flange portions 40e and 38e. Of course, the fluid connection between the spaces 36c and 40c may be done in the same manner as in the case between the spaces 40c and 38c.

Figure 4:
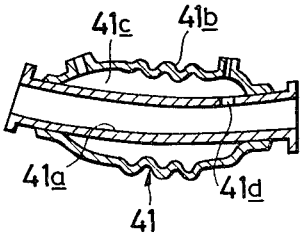
FIG. 4 is a longitudinal sectional view showing a modified construction of a part indicated by circle B in FIG. 1.

In FIG. 4, there is illustrated a modified connecting tube 41 which is located between the thermal reactor 36 and the catalytic converter 38 shown in FIG. 1. The connecting tube 41 is provided at its outer shell 41b with corrugations for preventing the tube 41 from heat expansion breakage. The outer shells 36b and 38b of the thermal reactor 36 and the catalytic converter 38 may be formed with suitable number of corrugations (not shown) for the same reason as mentioned above.

Figure 5:
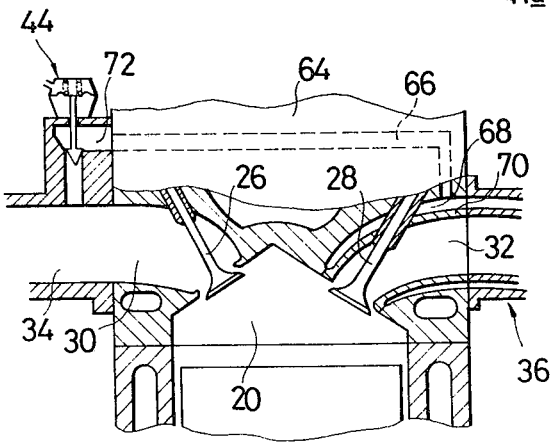
FIG. 5 is a longitudinal sectional view of a cylinder head employable as a part of the engine system of the subjected invention.

In FIG. 5, a modified cylinder head 64 is shown. The cylinder head 64 has therein a passage 66 which acts as the connecting pipe 46 of FIG. 1. As shown, one end of the passage 66 is open to an insulating space 68 formed around a port liner 70 disposed in the exhaust port 32, and the other end of the passage 66 is connected to the intake manifold 34 through a passage 72 in which the gas flow controller 44 is incorporated. The thermal reactor 36 is connected to the cylinder head 64 such that the insulating space 36c thereof is merged with the insulating space 68 of the cylinder head 64. With this, the entire construction of the engine system 10 can be made more compact in size.

Although in the previous description, it has been described that the gas conveying conduits of the EGR section are formed in the thermal reactor, the connecting tube and the catalytic converter, it is also possible to use any other exhaust conduit means such as the tail pipe 42 as long as the means has therein the insulating space.

It will be appreciated that, since the insulating spaces of the exhaust conduit section form substantially the gas conveying conduit of the EGR section, the engine system equipped with such EGR system can be constructed compact in size and economical with simple layout.

What is claimed is:

1. An internal combustion engine system having an engine proper and an intake manifold fluidly connected to said engine proper to convey an air-fuel mixture fed into the same, said engine system comprising:

a first exhaust conduit section including a first inner shell member defining therein a first exhaust gas passage through which the exhaust gases from the engine proper are passed, and a first outer shell member substantially covering said first inner shell member to define between said first inner and outer shell members a first insulating space, said first inner shell member being formed with at least one opening to provide a fluid communication between said first exhaust gas passage and said first insulating space;

a second exhaust conduit section including a second inner shell member defining therein a second exhaust gas passage through which the exhaust gases from said first exhaust gas passage of said first exhaust conduit section are passed before discharged into the open air, and a second outer shell member substantially covering said second inner shell member to define between said second inner and outer shell members a second insulating space, said second inner shell member being formed with at least one opening to provide a fluid communication between said second exhaust gas passage and said second insulating space;

first conduit means for providing a fluid communication between said first insulating space and the interior of said intake manifold; and second conduit means for providing a fluid communication between said first and second insulating spaces.

2. An internal combustion engine system as claimed in claim 1, in which said first and second conduit means are pipes.

3. An internal combustion engine system as claimed in claim 1, in which said second conduit means is mutually communicating with said first and second exhaust conduit sections through holes respectively formed in flange portions provided on said first and second exhaust conduit sections, respectively.

4. An internal combustion engine system as claimed in claim 1, further comprising a gas flow controller disposed in said first conduit means to control the flow rate of the exhaust gases fed into the intake manifold from said engine proper in response to the degree of venturi vacuum created in a portion upstream of said intake manifold.

5. An internal combustion engine system as claimed in claim 1, in which said first inner shell member and said first outer shell member are united with each other to form a monocast thermal reactor which functions to combust the harmful compounds contained in the exhaust gases from said engine proper.

6. An internal combustion engine system as claimed in claim 5, in which said second inner shell member and said second outer shell member are united with each other to form a monocast body containing therein catalyst thereby to construct a catalytic converter.

7. An internal combustion engine system as claimed in claim 1, in which said first conduit means is a passage formed in the cylinder head of said engine proper.

8. An internal combustion engine system as claimed in claim 7, in which said first conduit means has another insulating space defined between an interior surface of an exhaust port formed in said cylinder head and an outer surface of a port liner disposed in said exhaust port, one end of said passage being open to said another insulating space.

9. An internal combustion engine system as claimed in claim 7, in which said first outer shell member is formed with corrugations.

* * * * *